United States Patent [19]

Simovits, Jr.

[11] Patent Number: 4,573,755

[45] Date of Patent: Mar. 4, 1986

[54] SPARK GAP DEVICE FOR A CATHODE RAY TUBE SOCKET

[75] Inventor: Stephen S. Simovits, Jr., Downers Grove, Ill.

[73] Assignee: American Plasticraft Co., Chicago, Ill.

[21] Appl. No.: 643,471

[22] Filed: Aug. 22, 1984

Related U.S. Application Data

[63] Continuation of Ser. No. 391,576, Jun. 24, 1982, abandoned.

[51] Int. Cl.[4] ..... H01R 13/53

[52] U.S. Cl. ..... 339/111; 339/143 T

[58] Field of Search ..... 339/111, 143 T; 313/318

[56] References Cited

U.S. PATENT DOCUMENTS 4,119,878 10/1978 Uda ..... 313/325

4,156,161 5/1979 Pittman ..... 313/325

*Primary Examiner*—Eugene F. Desmond

*Attorney, Agent, or Firm*—Leo J. Aubel

[57] ABSTRACT

This invention relates to a spark gap device which provides overvoltage protection; that is, if a voltage above a predetermined value is applied to a contact of a cathode ray tube socket, such voltage is dissipated to ground to thereby protect circuitry connected to the socket.

2 Claims, 7 Drawing Figures

FIG. 1
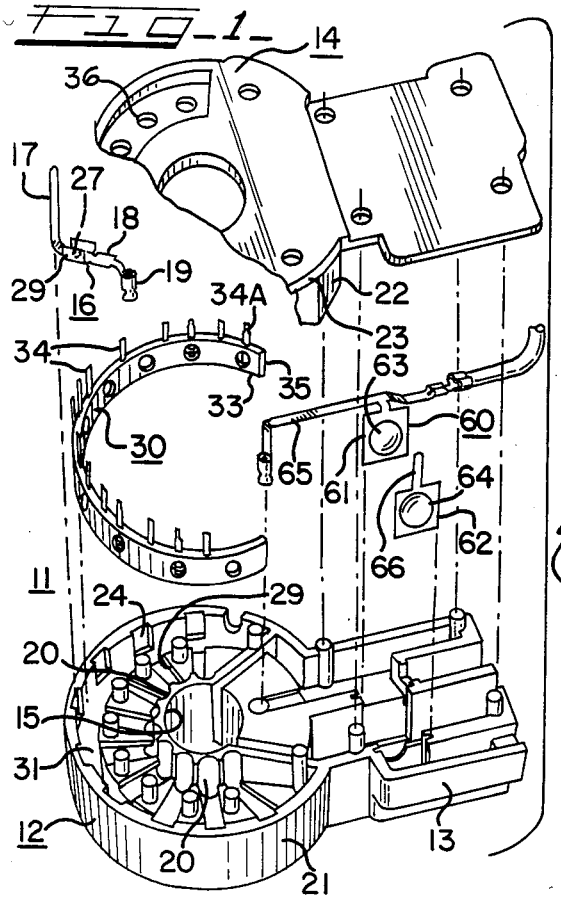
FIG. 6A
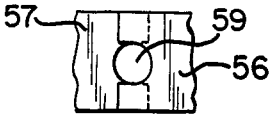
FIG. 6
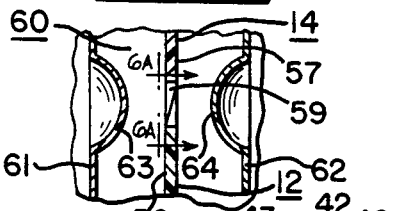
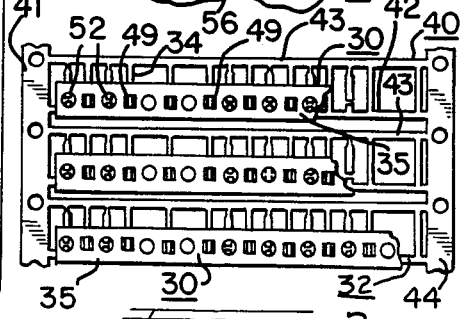
FIG. 2
FIG. 3
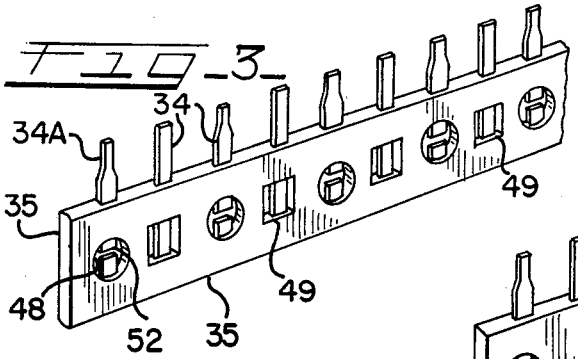
FIG. 4
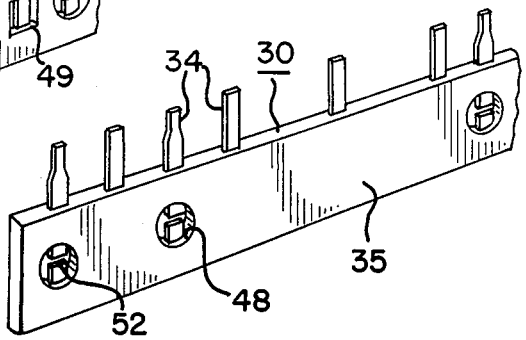
FIG. 5
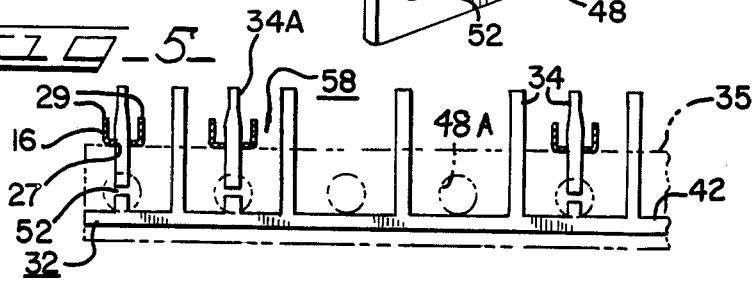

SPARK GAP DEVICE FOR A CATHODE RAY TUBE SOCKET

This application is a continuation of application Ser. No. 391,576, filed June 24, 1982, now abandoned.

DESCRIPTION

1. Technical Field

The present invention relates generally to a spark gap device which provides overvoltage protection.

2. Background Prior Art

A cathode ray tube (CRT) socket having a spark gap device is disclosed, for example, in U.S. Pat. No. 3,251,016 (incorporated herein by reference), entitled ELECTRON TUBE SOCKETS, issued to Manetti, et al., and assigned to the same assignee as the present invention. In Pat. No. 3,251,016, a conductor ring is incorporated in a spaced relation to contacts housed in a socket; and spark gaps are formed between the conductor ring and the contacts.

A CRT socket disclosed in Simovits, et al., U.S. Pat. No. 3,636,412, for "Tube Socket Assembly", also assigned to the same assignee as the present invention, and incorporated herein by reference, provides spark gaps obtained by forming a piece of metal and affixing the metal to an insulating substrate forming one part of the body of the socket, and then cutting or punching the metal at required positions to form the spark gaps.

In U.S. Pat. No. 4,119,878, issued to Uda and entitled "Spark Gap Device for a Cathode Ray Tube", spark gaps are formed from a flexible coupling link. The spark gaps are formed by cutting an extending piece and forming a space therebetween; one cut end is adapted to be connected to a contact pin of the cathode ray tube socket and the other cut end is connected to ground reference. The respective pairs of cut ends comprise electrodes, each formed integrally with an individual molding piece. In this latter patent, the electrodes are positioned; and spark gaps are each formed on separate molding pieces; that is, each pair of spark gap electrodes is molded in a separate molding piece. Further, each molding piece is positioned in a separate respective recess formed in the socket assembly.

SUMMARY OF THE INVENTION

The present invention is an improvement over the prior art in that it provides a spark gap electrode assembly, with all of the electrodes being encapsulated in a single molding strip to provide a more accurate and precise positioning of a spark gap assembly in the associated tube socket. The present invention enables intensive automatic assembly of the spark gap structure in a cathode ray tube socket. The structure of the invention has found extensive practical application for the lower voltage spark gaps, say in the 1.5 kV to 3.5 kV application.

One method of manufacturing the spark gap assembly of this invention is in the following manner. Conductive fingers are formed to extend between a pair of spaced horizontally extending arms, which arms extend to vertical rails forming the sides of a rectangular frame, all of which may be formed by punching or chemical etching of a flexible sheet metal. Selected ones of the coupling fingers are cut to form spaced spark gap electrodes. One of the extending arms adjacent the spark gaps couples to a signal source; and the other arm is a ground reference coupling member. A flexible plastic strip or piece is molded to encompass the extendig arms and the conductive fingers. An aperture is formed in the plastic piece at the area of the spark gaps to provide an air dielectric chamber. Each pair of extending arms, the conductive fingers and the plastic piece form the spark gap assembly for a given socket. A plurality of such units are formed concurrently, and then severed into the individual assemblies.

BRIEF DESCRIPTION OF SEVERAL VIEWS OF DRAWINGS

The foregoing features and advantages of the present invention will be apparent from the following more particular description of the invention. The accompanying drawings, listed hereinbelow, are useful in explaining the invention wherein:

FIG. 1 is an exploded view of the inventive socket;

FIG. 2 shows the spark gap structure of FIG. 1 as it appears during a step in its fabrication;

FIG. 3 shows one embodiment of a spark gap assembly relatively enlarged with reference to FIG. 1 to more clearly show the details thereof;

FIG. 4 shows a second embodiment of the spark gap assembly;

FIG. 5 is an enlarged view relative to FIG. 1 to show a variation of the embodiment of FIG. 1, including a second or back-up spark gap;

FIG. 6 shows an enlarged view relative to FIG. 1 to show the structure of the high voltage spark gaps of FIG. 1; and FIG. 6*a* is a view taken along Lines 6A—6A of FIG. 6 to show the overlapping of the associated plates.

DETAILED DESCRIPTION

FIG. 1 shows an exploded view of the inventive socket assembly 11, comprising a base 12, having a rectangularly-shaped extension 13, and a cover 4, both of which are formed or molded of a suitable relatively rigid insulative material, such as plastic. The socket 11 includes a central passage 15 for mounting onto the terminal portion of the neck of a cathode ray tube (not shown). Terminal pins 16 (only of which is shown) each comprise a first vertical portion 17 for soldering to suitable electronic circuitry, a horizontal portion 18 which is supported on base 12, and a downwardly-extending tubular portion 19 which extends into respective holes 20 in base 12 to connect to the terminal pins of the cathode ray tube. The central portion 18 includes two upstanding flanges 29 (see also FIG. 5) on either side thereof, and a hole 27 formed therein, for purposes to be described. A high voltage arc gap, generally labeled 60, which will be explained hereinafter, is also mounted in base 12 and forms part of the socket assembly.

The base 12 is generally in an irregular circular form, in plan view, as is the entire socket assembly 11. The base 12 includes an upwardly extending peripheral wall 21. The inside surface of wall 21 of base 12 includes positioning notches 24 for receiving the respective terminal pins 18. The cover 14 includes a depending wall 22 and ledge 23, which mate with and are abutted to wall 21 to thus fully cover base 12. When terminal pins 16 are mounted into the base 12, the horizontal portion 18 of pins 16 is supported in an associated groove 31 formed in the base 12; and the vertical portion 17 of pins 16 extends upwardly through holes 36 in cover plate 14.

The spark gap assembly 30 comprises a flexible inner metallic piece 32, encapsulated in a flexible plastic insulating strip or bands 35, such as of a polypropolene or polycarbonate. This flexible assembly 30, which is formed or bent into an arc of a ring or circular element 33, is an important feature of the invention, and will be described in detail hereinafter. The assembly 30 is inserted into a circular recess or groove 31 in base 12, with selected vertical portions or fingers of assembly 30, generally labeled 34 in FIG. 1, extending upwardly and engaging the terminal pins 16.

As more clearly seen in FIGS. 3–5, certain of the fingers (note fingers labeled 34A) are reduced in contour at their free ends and are inserted into associated holes 27 formed in the support portion 18 of terminal pin 16 to make mechanical and electrical contact between an electrode of the spark gap assembly 30 and the associated terminal pin 16. The fingers 34 not inserted in pins 16 are electrical, open at their free ends and add structural strength to the unit.

As indicated in FIG. 4, the spark gap assembly 30 of the invention is preferably formed in multiple groupings, initially comprising a metallic matrix 40. More specifcally, the metallic matrix comprises a pair of side rails 41 and 44, with pairs of metallic arms 42 and 43 extending thereacross. A multiplicity of spaced vertical projections or fingers, generally labeled 34, extend between the pairs of arms 42 and 43.

In the fabrication, matrix 40 is initially stamped out to provide the holes, rails, arms and fingers. A flexible plastic strip or band 35 is next molded in position to encapsulate the lower arm pair 42 and the lower portion of each of the fingers 34. The upper end of each of the fingers 34 remains unencapsulated.

As also seen in FIG. 3, holes 48 are formed in strip 35 in the area of selected fingers 34, completely through the strip, to provide arc gap chambers, as will be explained. Recesses 49 are formed in strip 35 in the area of other fingers 34, but do not extend through the strip 35. Recesses 49 enhance the flexibility of strip 35.

Either prior to or after plastic strip 35 has been molded on the arm 42 and fingers 34, selected ones of the fingers 4 are severed, as indicated at 52, to provide a spark gap, as is well-known in the art, As is known, the size of the spark gap, that is, the spacing between the severed ends of the fingers 34, provides a pair of spaced electrodes to determine the operational characteristics of the spark gap. Each assembly 30 is then severed from the matrix 40; each assembly 30 is severed along its edge to remove arm 43 from fingers 34 to leave the fingers with an open end, as shown in FIG. 3. Note that the ends of arms 42 are also severed from rails 41 and 44 to thereby provide a strip or band, as indicated in FIG. 3. As mentioned above, the spark gap assembly 30 is next flexed and inserted into annular recess 31 in the socket base 21. The assembly 30 is dimensioned such that, as mentioned above, the fingers are properly positioned to enable fingers 34A to properly enter into the respective holes 27 in the associated portions 18 of terminal pins 16. The fingers 34A frictionally fit into holes 27 to make mechanical and electrical contact therewith.

A modification of the structure of FIG. 3 is shown in FIG. 4, wherein the recesses 49 are omitted. The structure of FIG. 3 may be utilized when the plastic strip 35 is of a relatively more flexible material.

FIG. 5 shows a modification of the structure of previous figures, wherein a safety spark gap 58 is formed in addition to the principal spark gap discussed above. In this latter modification, the flange 29 of the terminal pin 16 are dimensioned to extend normaly toward adjacent fingers 34 a selected distance. A spark gap 58, indicated in FIG. 5, is formed between the flanges 29 and the adjacent finger 34, which is a wider gap than that shown for the principal spark gap 52. Safety spark gap 58 functions as a back-up for spark gap 52. If, for example, the voltage across the spark gap 52 is abnormally large, a gap 58 will also arc (in addition to the associated gap 52) and shunt a portion of the voltage energy to ground. The latter gap 58 will not interfere with the functioning primary gap 52.

Hole 48A may be formed between the fingers 34 in the plastic strip 35 in order to enhance the flexibility of the strip.

It has been found that the inventive strip 35 provides a lower capacitance between fingers 34, as compared to the structure of above-noted U.S. Pat. No. 4,119,878, which is an advantageous feature for high frequency application.

FIG. 6 shows the high voltage spark gap 60 of FIG. 1 in cross-section. FIG. 1 shows the positioning of the high voltage spark gap device 60, comprising a pair of plates 61 and 62 having inwardly directed ball-shaped shoulders or projections 63 and 64, which are spaced a selected amount apart, as is well-known in the art, to provide spark gap electrodes. The plates 61 and 62 extend downwardly into a suitable recess in the extension portion 13 of base 12. Note that the plate 61 extends from, and is directly affixed to, a terminal pin 65 insertable in the base 2 to provide an integral electrode and terminal pin construction for the voltage spark gap device 60. The other plate 62 of spark gap device 60 comprises a single rectangular piece, with an extension 66 for connecting to suitable grounding circuitry. As indicated in FIG. 6, the cover 14 includes a downwardly extending wall 57 which has a beveled end, which overlaps against the beveled end of an upwardly extending wall 56 of base 12 (see FIG. **6*a*). Each of walls 57 and 56 are configured to form a portion of a hole such that, when the two walls are overlapped against each other, the two circular portions form a circular hole 59. The structure of FIGS. 6 and 6*a* provide a corona disruption capability. Since corona precedes dielectric breakdown, a corona discharge adversely affects and changes the selected and pre-established voltage breakdown or arcing potential between the electrodes. It has been found that the smooth sides of the ball electrode may enable a corona discharge path initiated at one electrode to extend or move along the walls of the chamber to the other electrode; and this tends to change the arcing potential between the two electrodes. The wall or divider 57 and 56 provides a selected aperture 59 through which any discharge across the electrodes must travel, thereby confining the discharge to a selected predetermined path. The dividers 57 and 56** also provide an effective barrier against electrode sputtering to thereby tend to inhibit corona discharge and to improve the arc gap protection provided by the inventive socket.

While the invention has been particularly shown and described with reference to a preferred embodiment thereof, it will be understood by those skilled in the art that various changes in form and details may be made therein without departing from the spirit and scope of the invention.

I claim:

1. A tube socket comprising a dielectric body, spark gap portions each having at least a pair of conductive electrodes disposed in spaced relation to one another, a flexible conductive link for coupling to one electrode of said pairs, conductive fingers extending from the other electrode of said pairs for connection to associated electronic circuitry, a unitary flexible elongated plastic band substantially completely encapsulating said flexible conductive link and encapsulating portions of said conductive fingers, spaced sections along said band being recessed to expose a portion of the associated finger, said band being bendable in the arc of a circle for mounting in said dielectric body, and said band having apertures formed at said spark gap portion location for forming an air dielectric chamber, spaced apertures along the length of said band to enhance the flexibility of said band and reduce the bending stresses, and said band being receivable in said dielectric body.

2. A tube socket as in claim 1 including terminal lead means having outstanding flanges, holes formed in said terminal lead means for mounting said terminal lead means onto selected fingers in electrical contact, and in position with said flanges extending between selected adjacent fingers to form safety arc gaps, between said selected adjacent fingers and said flanges with said safety arc gap having a wider gap spacing than the spacing between the spark gap electrodes, whereby said safety arc gaps do not interfere with the operation of said spark gaps but will provide discharge arc gaps for larger overvoltage.

* * * * *